US005153549A

United States Patent [19]

Morinaga

[11] Patent Number: 5,153,549

[45] Date of Patent: Oct. 6, 1992

[54] COIL INDUCTOR WITH METAL FILM ON WIRE

[75] Inventor: Tetsuya Morinaga, Nagaokakyo, Japan

[73] Assignee: Murata Manufacturing Co., Ltd., Nagaokakyo, Japan

[21] Appl. No.: 770,315

[22] Filed: Oct. 3, 1991

[30] Foreign Application Priority Data

Oct. 5, 1990 [JP] Japan ..... 2-269204

[51] Int. Cl.[5] ..... H01F 27/28

[52] U.S. Cl. ..... 336/177; 174/126.2; 336/192; 336/222

[58] Field of Search ..... 174/126.2; 336/177, 336/222, 223, 192

[56] References Cited

U.S. PATENT DOCUMENTS

| | | | |
|---|---|---|---|
| 1,904,241 | 4/1933 | Kammerer | 174/126.2 X |
| 4,441,118 | 4/1984 | Fister et al. | 174/126.2 X |
| 4,549,043 | 10/1985 | Kalubowila et al. | 174/126.2 X |
| 4,769,900 | 9/1988 | Morinaga et al. | 336/192 X |

*Primary Examiner*—Thomas J. Kozma

*Attorney, Agent, or Firm*—Burns, Doane, Swecker & Mathis

[57] ABSTRACT

An inductor having a metal wire which is made of a copper base wire, a first film of a metal which is diffusible into solder, on the copper base wire, a second film of a metal which has fine solderability, on the first metal film, and an insulating coat on the second metal film.

13 Claims, 1 Drawing Sheet

COIL INDUCTOR WITH METAL FILM ON WIRE

BACKGROUND OF THE INVENTION

1. Field of the Invention

The present invention relates to a coil inductor, and more particularly to a coil inductor employed in an electric circuit such as a filter circuit or an oscillation circuit.

2. Description of Related Art

A copper wire which is covered with an insulating coat such as polyurethane has been used as a coil of a coil inductor. After the wire is coiled, the insulating coat of the wire is partly removed at an end, and the bare end of the copper wire is soldered to a terminal (or an electrode).

The coil, particularly the copper wire is thinned, when the inductance is wanted to be increased, or the inductor is wanted to be more compact. However, since copper is diffusible into solder, using an excessively thinned wire causes a problem that the copper partly diffuses into the solder to breaking of the wire when the wire is connected to the terminal (or the electrode) or when the inductor is mounted on a printed-wiring board by soldering. Therefore, the diameter of the copper wire had to be kept approximately 50 μm at the minimum, and could not be thinned more.

SUMMARY OF THE INVENTION

An object of the present invention is to provide a compact inductor which has large inductance.

We attempted to attain the object by solving the problem that the diffusion of copper into solder prevents the thinning of the coil. This is realized by using a metal wire comprising a copper wire; a first metal film covering the copper wire, the first metal film being made of a metal which is not diffusible into solder; and a second metal film covering the first metal film, the second metal film being made of a metal which has fine solderability.

In a coil inductor employing the above wire, the first metal film prevents diffusion of copper into solder, and the second metal film ensures fine solderability. Moreover, since a core material of the wire is copper as in a conventional coil inductor, an electrical performance such as direct current resistance will not be damaged. For example, Ni, Fe, Pd, NiCu, etc. are used as the material of the first metal film, and Cu, Sn, Ag, Au, Cd solder, etc. are used as the material of the second metal film.

According to the present invention, a metal wire comprising a copper wire which is 10 to 40 μm in diameter can be used as a coil of a coil inductor which has larger inductance than a conventional coil inductor of the same size because the number of coiling can be increased within the same space. Also, it is possible to obtain a coil inductor which is more compact than a conventional coil inductor having the same inductance.

BRIEF DESCRIPTION OF THE DRAWING

This and other objects and features of the present invention will become apparent from the following description taken in conjunction with the preferred embodiments in reference to the accompanying drawings, in which.

DETAILED DESCRIPTION OF THE PREFERRED EMBODIMENTS

Figure 1:
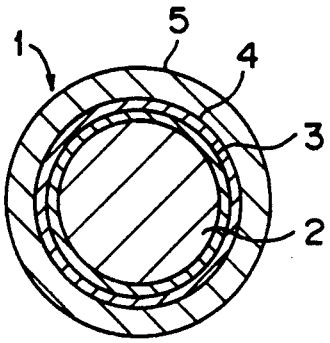
FIG. 1 is a cross-sectional view of a wire which is an essential component of a coil inductor according to the present invention.

The description of preferred embodiments according to the present invention is given below, referring to the drawings.

FIG. 1 shows a cross-sectional view of a wire 1. A copper wire 2 is used as a core of the wire 1, and the wire 1 is covered with a first metal film 3 of, for example, 0.1 to 2 μm thickness. The first metal film 3 is formed by plating or cladding a metal which is not diffusible into solder, such as Fe, Ni, Pd, Pt and NiCu (monel). Further, the first metal film 3 is covered with a second metal film 4 of, for example, 0.1 to 2 μm thickness. A metal which has fine solderability, such as Cu, Sn, Ag, Au, Cd and solder, is used as the second metal film 4. The copper wire 2 covered with the metal films 3 and 4 is finished as the wire 1 by covering the second metal film 4 with an insulating coat 5 made of polyurethane resin and the like.

Figure 2:
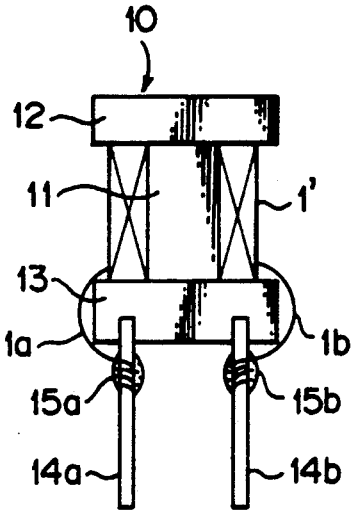
FIG. 2 is an elevation view of the coil inductor whose wire is coiled around a ferrite core, showing the coil part in a sectional view.

The wire 1 of the above structure is coiled around a ferrite core 10 as shown in FIG. 2. The ferrite core 10 is composed of a body 11 and flanges 12 and 13 installed at upper and lower ends of the body 11. The coil 1' is coiled around the body 11 of the core 10, and the insulating coat 5 of the coil 1' is removed both ends 1*a* and 1*b*, so that the metal film 4 is exposed at the ends 1*a* and 1*b*. The both ends 1*a*, 1*b* are bound around terminals 14*a* and 14*b* which are in stalled at the lower flange 13 of the core 10, and soldered by solders 15*a* and 15*b*.

Since the coil inductor of the above structure has the copper wire 2 covered with the first metal film 3 and the second metal film 4, when the ends 1*a* and 1*b* of the coil 1' are soldered to the terminals 14*a* and 14*b*, or when the inductor is soldered to a printed-wiring board, diffusion of copper into solder is avoided. More specifically, the first metal film 3 which is formed on the surface of the copper wire 2 prevents the copper from diffusing into the molten solder, and the second metal film 4 compensates for bad solderability of the first metal film 3.

Therefore, a thin copper wire (for example, a copper wire of 10 to 40 μm diameter) can be used as a component of a coil inductor, and it becomes possible to increase the inductance and decrease the dimensions.

Figure 3:
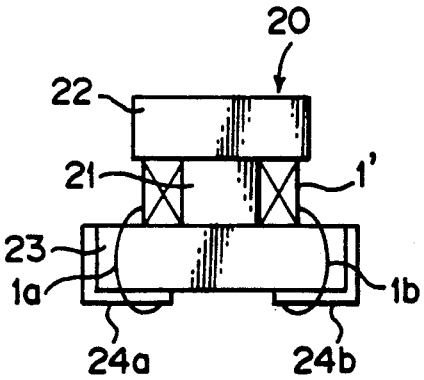
FIG. 3 is an elevation view of another coil inductor according to the present invention, showing the coil part in a sectional view.

FIG. 3 shows another embodiment of the coil inductor according to the present invention. This coil inductor is a surface mounting type.

The ferrite core 20 is composed of a body 21 and flanges 22 and 23 which are provided at upper and lower ends of the body 21. The wire 1 shown in FIG. 1 is used as the coil 1', and coiled around the body 21 of the core 20. The both ends 1*a* and 1*b* are soldered to electrodes 24*a* and 24*b* which are installed at the lower flange 23 of the core 20.

Since the wire 1 shown in FIG. 1 is also used for this coil inductor, the coil inductor has the same effect as shown in FIG. 2.

Although the present invention has been described in connection with the preferred embodiments above, it is to be noted that various changes and modifications are apparent to a person skilled in the art. Such changes and modifications are to be understood as being within the scope of the present invention defined by the appended claims.

For example, an air-core inductor, a mutual inductor and the like can be composed using the wire which is shown in FIG. 1.

What is claimed is:

1. An inductor having a metal wire coiled around a ferrite core, the metal wire comprising:

a copper wire as a core material;

a first metal film covering the copper wire, the first metal film being made of a metal which is not diffusible into solder;

a second metal film covering the first metal film, the second metal film being made of a metal which has fine solderability; and an insulating coat covering the second metal film.

2. An inductor as claimed in claim 1, wherein the first metal film is made of a metal material selected from the group consisting of Ni, Fe, Pd and NiCu.

3. An inductor as claimed in claim 1, wherein the second metal film is made of a metal material selected from the group of consisting of Cu, Sn, Ag, Au and Cd.

4. An inductor as claimed in claim 1, wherein ends of the metal wire are connected to electrodes.

5. An inductor as claimed in claim 1, wherein ends of the metal wire are connected to terminals.

6. An inductor as claimed in claim 1, wherein said copper wire has a diameter of 40 μm or less.

7. An inductor comprising:

a ferrite core having a body with an upper end and a lower end;

at least one terminal extending from at least one of said upper end and said lower end;

a conductor coiled around said ferrite core and bound to said at least one terminal, said conductor further including:

a copper wire;

a first metal film surrounding the copper wire, said first metal film being non-diffusible into solder;

a second metal film surrounding said first metal film, said second metal film being diffusible into solder; and an insulator surrounding at least a portion of the copper wire, the first metal film and the second metal film.

8. An inductor as claimed in claim 7, wherein said copper wire has a diameter of 40 μm or less.

9. An inductor as claimed in claim 8, wherein said copper wire portion surrounded by said insulator is coiled around said ferrite core.

10. An inductor as claimed in claim 9, wherein the first metal film is made of a metal material selected from the group consisting of Ni, Fe, Pd and NiCu.

11. An inductor as claimed in claim 10, wherein the second metal film is made of a metal material selected from the group of consisting of Cu, Sn, Ag, Au and Cd.

12. An inductor as claimed in claim 11, wherein said first and said second metal layers each have a thickness of 0.1 to 2 μm.

13. An inductor as claimed in claim 12, wherein said insulator is a polyurethane insulator.

* * * * *